US008382471B2

(12) United States Patent
Lonardi et al.

(10) Patent No.: US 8,382,471 B2
(45) Date of Patent: Feb. 26, 2013

(54) MULTIPLE HEARTH FURNACE

(75) Inventors: Emile Lonardi, Bascharage (LU); Patrick Hutmacher, Bettembourg (LU); Edgar Kraemer, Hellange (LU); Paul Tockert, Luxembourg (LU)

(73) Assignee: Paul Wurth S.A., Luxembourg (LU)

( * ) Notice: Subject to any disclaimer, the term of this patent is extended or adjusted under 35 U.S.C. 154(b) by 767 days.

(21) Appl. No.: 12/527,034

(22) PCT Filed: Feb. 15, 2008

(86) PCT No.: PCT/EP2008/051908

§ 371 (c)(1),
(2), (4) Date: Aug. 13, 2009

(87) PCT Pub. No.: WO2008/099024

PCT Pub. Date: Aug. 21, 2008

(65) Prior Publication Data

US 2010/0129759 A1 May 27, 2010

(30) Foreign Application Priority Data

Feb. 16, 2007 (LU) ..... 91312

(51) Int. Cl.
*F27B 9/02* (2006.01)

(52) U.S. Cl. ..... 432/131; 165/93; 110/225

(58) Field of Classification Search ..... 432/95, 432/96, 98, 131; 165/92, 93; 110/225
See application file for complete search history.

(56) References Cited

U.S. PATENT DOCUMENTS

| | | | | |
|---|---|---|---|---|
| 1,164,130 | A | 12/1915 | Skinner | |
| 1,465,416 | A * | 8/1923 | Call et al. | 165/93 |
| 1,468,216 | A | 9/1923 | Skinner | |
| 1,535,160 | A * | 4/1925 | Jette | 165/93 |
| 1,674,919 | A * | 6/1928 | Pike | 432/131 |
| 1,687,935 | A | 10/1928 | Fowler | |
| 1,732,844 | A * | 10/1929 | Halse | 165/93 |
| 1,852,600 | A * | 4/1932 | Connolly et al. | 165/93 |
| 2,332,387 | A * | 10/1943 | Martin | 165/92 |
| 3,419,254 | A * | 12/1968 | Von Dreusche, Jr. | 432/131 |
| 4,034,969 | A * | 7/1977 | Grimes | 266/82 |
| 5,316,471 | A * | 5/1994 | Nell | 432/139 |

FOREIGN PATENT DOCUMENTS

| | | |
|---|---|---|
| DE | 263 939 | 9/1913 |
| DE | 268 602 | 12/1913 |
| DE | 350646 | 3/1922 |
| FR | 620316 | 4/1927 |

OTHER PUBLICATIONS

International Search Report; PCT/EP2008/051908; Apr. 14, 2008.

* cited by examiner

*Primary Examiner* — Gregory A Wilson

(74) *Attorney, Agent, or Firm* — Cantor Colburn LLP

(57) ABSTRACT

A multiple hearth furnace including a rabble arm with a tubular structure and a solid plug body. The latter is received in a socket arranged in an arm fixing node. It has an axial through boring and cooling fluid supply and return channels arranged around this through boring. A clamping bolt is rotatably fitted in the through boring. It has a bolt head, which can be brought by rotation into and out of hooking engagement with an abutment surface on the arm fixing node. A threaded end of the clamping bolt sticks out of the through boring at the rear end of the plug body. A threaded sleeve, which is screwed onto this threaded end, bears on an abutment surface at the rear end of the plug body for exerting a clamping force onto the clamping bolt.

21 Claims, 5 Drawing Sheets

MULTIPLE HEARTH FURNACE

TECHNICAL FIELD OF THE INVENTION

The present invention generally relates to a multiple hearth furnace (MHF).

BRIEF SUMMARY OF RELATED ART

Multiple hearth furnaces (MHFs) have been used now for about one century for heating or roasting many types of material. They comprise a plurality of hearth chambers arranged one on top of the other. Each of these hearth chambers comprises a circular hearth having alternately a central material drop hole or a plurality of peripheral material drop holes therein. A vertical rotary shaft extends centrally through all these superposed hearth chambers and has in each of them a rabble arm fixing node. Rabble arms are connected in a cantilever fashion to such a rabble fixing node (normally there are two to four rabble arms per hearth chamber). Each rabble arm comprises a plurality of rabble teeth extending downwards into the material on the hearth. When the vertical rotary shaft is rotated, the rabble arms plough material on the hearth with their rabble teeth either towards the central drop hole or towards the peripheral drop holes in the hearth. Thus, material charged into the uppermost hearth chamber is caused to move slowly downwards through all successive hearth chambers, being pushed by the rotating rabble arms over the successive hearths alternately from the periphery to the center (on a hearth with a central material drop hole) and from the center to the periphery (on a hearth with peripheral material drop holes). Arrived in the lowermost hearth chamber, the roasted or heated material leaves the MHF through a furnace discharging opening.

In a MHF, the vertical rotary shaft as well as the rabble arms are tubular structures that are cooled by a cooling fluid, usually a gaseous cooling fluid as ambient air (for the sake of simplicity, the gaseous cooling fluid will be called herein "cooling gas" even if it is a mixture of several gases). The vertical rotary shaft includes a cooling gas distribution channel for supplying the cooling gas to the rabble arms. From this cooling gas distribution channel, the cooling gas is channeled through the connection between the rabble arm and the rabble arm fixing node into the tubular structure of the rabble arm. As the cooling system of the rabble arm is normally a closed system, the cooling gas returning from the rabble arm must be channelled through the connection between the rabble arm and the rabble arm fixing node into an exhaust gas channel in the vertical rotary shaft.

The connection between a cantilever rabble arm and the vertical rotary shaft must fulfil at least following requirements. It must be strong enough to support not only the weight of the arm but also the considerable torque and shearing forces generated when the rabble teeth plough through the material on the hearth. It must be reliable at operating temperatures of the MHF, i.e. temperatures up to 1000° C., and when the rabble arm is subjected to vibrations. It must be capable of channeling the cooling gas from the vertical rotary shaft to the rabble arm and vice versa, with reasonable pressure loss and without cooling gas leakage into a hearth chamber and between the supply flow and the return flow of the cooling gas. Last but not least, it should allow an easy exchange of the rabble arm, preferably without having to completely cool down the MHF.

In the last hundred years, there have been described many different connections between the cantilever rabble arm and the vertical rotary shaft. For example:

U.S. Pat. Nos. 1,164,130 and 1,468,216 both describe a MHF in which the rabble arm is provided with a tubular coupling end that fits into a socket provided in the vertical rotary shaft. The tubular coupling end of the rabble arm is basically a cylindrical body but it may be slightly tapered. In order to secure the rabble arm in proper position, its tubular coupling end is provided with a locking lug, adapted to pass through a slot provided in a rim at the entrance of the socket and to engage a sloping inner edge of a locking shoulder or cam surface provided on the inner wall of the socket. The tubular coupling end of the rabble arm is introduced into the socket and then given a 90° turn to engage the locking lug behind the locking shoulder and draw the tubular coupling end of the rabble arm into the socket. A stop shoulder is provided on the inner wall of the socket to prevent further turning movement of the rabble arm when the parts have been brought into proper position. Such a prior art locking system may easily loosen during operation of the MHD. Furthermore, giving a 90° turn to the rabble arm to secure it within the socket is not an easy operation within a hearth chamber.

FR 620.316 describes a MHF in which the rabble arm is provided with a tubular cylindrical coupling end that fits into a cylindrical socket provided in a rabble arm fixing node of the vertical rotary shaft. A bent tie rod extends over the whole length of the rabble arm through one of two superposed channels in the rabble arm. The end of the tie rod that protrudes eccentrically out of the tubular cylindrical coupling end of the rabble arm supports a dove-tail head to engage a dove-tail groove in an internal wall of rabble arm fixing node. The end of the tie rod protrudes axially out of the front end of the rabble arm and supports a thread on which is screwed a nut. Tightening this nut axially presses the tubular cylindrical coupling end of the arm into its cylindrical socket in the rabble arm fixing node. It is obvious that it will be not very easy to engage the dove-tail head of the tie rod into the dove-tail groove in the rabble arm fixing node.

U.S. Pat. No. 1,687,935 describes a MHF in which the rabble arm is provided with a tubular conical coupling end engaging an adapter member on the shaft. The tubular conical coupling end has two spaced convex cylindrical bearing portions thereon. The smaller convex cylindrical bearing portion located at the front end of the tubular conical coupling end engages a cylindrical coupling sleeve of a conduit inside the adapter member. The bigger convex cylindrical bearing portion located at the rear end of the tubular conical coupling end engages a cylindrical coupling sleeve at the entrance of the adapter member. A radial securing pin is used to secure the tubular conical coupling end of the rabble arm within the adaptor member. Such a rabble arm locking system may easily loosen when the rabble arm is subjected to vibrations. Furthermore, one can easily imagine that it will be not very easy to mount or dismount the securing pin without entering into the MHF. Last but not least, the adapter member as described in U.S. Pat. No. 1,687,935 is most probably too bulky to be integrated into a normal sized vertical rotary shaft.

U.S. Pat. No. 3,419,254 describes a MHF in which the fixing system for the cantilever rabble arms is similar to the system described in U.S. Pat. No. 1,687,935. The rabble arm is provided with a tubular conical coupling end engaging an opening in the shaft. The tubular conical coupling end has two spaced convex cylindrical bearing portions thereon. The smaller convex cylindrical bearing portion located at the front end of the tubular conical coupling end engages an opening in an inner tubular member of the vertical rotary shaft. The bigger convex cylindrical bearing portion located at the rear end of the tubular conical coupling end engages a cylindrical coupling surface surrounding an opening within an outer tubular member of the shaft. A radial securing pin is used to secure the tubular conical coupling of the rabble arm within the shaft. Such a rabble arm locking system may loosen when the rabble arm is subjected to vibrations. Furthermore, one can e.g. easily imagine that it will be not very easy to mount or dismount the securing pin without entering into the MHF. Last but not least, the integration of cylindrical bearing openings for the tubular conical coupling end directly into the inner and outer tubular member of the vertical rotary shaft necessitates considerable local reinforcement of this inner and outer tubular member and causes moreover problems as far as gas tightness is concerned.

U.S. Pat. No. 1,732,844 describes a MHF in which the rabble arm is provided with a tubular coupling end that fits into a socket provided in big diameter vertical rotary shaft. A concave conical seat surface is arranged around the inlet of the socket and a convex conical counter-seat surface formed by a shoulder on the tubular coupling end of the rabble arm. The tubular coupling end is secured in its socket by means of a pawl that can be operated from the interior of the shaft and that is engaging a shoulder formed on the tubular coupling end of the rabble arm. It is obvious that such a rabble connecting system is only possible for a MHF having a big diameter vertical rotary shaft, which permits securing the rabble arms from the inside of the vertical rotary shaft.

DE 350646 describes a MHF which has been conceived to be used with air and water as cooling fluid. The rabble arm is provided with a tubular coupling end that fits into connecting box of a big diameter vertical rotary shaft. The connecting box comprises inlet opening surrounded by a first concave conical seat surface and an internal partition wall with a second opening therein. The inlet opening gives access to a first connection chamber and the opening in the internal partition wall gives access to a second connection chamber, which is separated from the first connection chamber by the internal partition wall. The tubular coupling end of the rabble arm has a shoulder forming a convex conical counter-seat surface sitting on the first concave conical seat surface surrounding the inlet opening of the connecting box. A conical extension of the tubular coupling extends in a sealed manner through the second opening into the second connection chamber. The conical extension of the tubular coupling supports a threaded rod that extends in sealed manner into the inside of the shaft, where it is secured by means of a nut. It is obvious that such a rabble connecting system is only possible for a MHF having a big diameter vertical rotary shaft for integrating therein a rather huge connecting box and allowing to secure the rabble arms from the inside of the vertical rotary shaft.

DE 263939 describes a rabble arm fixed to a vertical rotary hollow shaft. The rabble arm includes a tubular structure of cast iron, which is designed for circulating therethrough a cooling gas. A cylindrical tubular coupling end of the rabble arm is received in a cylindrical socket arranged in the vertical rotary hollow shaft. A shoulder surface of this coupling end sits on a seat surface surrounding the socket on the vertical shaft. A seal ring is arranged between the shoulder surface of the coupling end and the seat surface on the vertical shaft. A clamping bolt, which extends from the coupling end of the rabble arm to the front end of the rabble arm, is provided for securing the rabble arm with its coupling end in the socket. This clamping bolt protrudes out of the coupling end of the rabble arm, where it has a bolt head that can be brought by rotation of the clamping bolt about its central axis into and out of hooking engagement with an abutment surface on the arm fixing node. At the front end of the rabble arm, a threaded sleeve is screwed onto a threaded end of the clamping bolt for exerting a clamping force onto the clamping bolt. In an alternative solution, the bolt head is designed as a screw-nut. It will be noted that the rabble arm securing means described in DE 263939 has major drawbacks. Already a slight mechanical deformation or an overheating of the rabble arm may indeed deform, damage or even rupture the clamping bolt extending through the rabble arm. It will in particular be noted that already small plastic elongations of the clamping bolt, due e.g. to an overheating of the rabble arm, will reduce the clamping force to zero. Last but not least, it will be very hard to dismount a rabble arm, once its clamping bolt has only slightly been deformed.

DE 268602 describes a tubular rabble arm which is said to overcome the drawbacks of the rabble arm disclosed in DE 263939. The rabble arm with its cylindrical coupling end form a one piece cast tube, with a cast-in central partition wall. The latter separates a first path for the cooling gas flowing to the front end of the rabble arm, from a second path for the cooling gas flowing back to the coupling end. A short length clamping bolt is arranged in a tubular socket axially protruding into the tubular coupling end. A first end of the clamping bolt protrudes out of the coupling end of the rabble arm, where it has a bolt head that can be brought by rotation of the clamping bolt about its central axis into and out of hooking engagement with an abutment surface on the arm fixing node. A threaded sleeve is screwed onto a threaded end of the clamping bolt protruding out the tubular socket. This threaded sleeve bears onto the end face of the tubular socket for exerting a clamping force onto the clamping bolt. The middle portion of the cast-in partition wall is curved over its whole length in order to provide free access to the threaded sleeve from the front end of the rabble arm; so that the threaded sleeve may be tightened or loosened with a key mount on a bar. The cooling gas supply means comprises an opening, which is arranged in the cylindrical wall of the tubular extension to communicate with said first path. The cooling gas return means comprises an opening, which is arranged in a base plate of the tubular extension to communicate with said second path.

In modern MHFs, the rabble arm comprises most often a connecting branch with a ring-flange for connecting a rabble arm thereto. The rabble arm comprises at its rear end a tubular coupling body with a counter-ring-flange that is bolted onto the ring-flange of the connecting branch. Such a flange-connection warrants high mechanical resistance, even at high operating temperatures of the MHF and does hardly loosen when the rabble arm is subjected to vibrations. However, exchanging a rabble arm with a flange-connection necessitates that workers penetrate into the hearth chamber for separating or renewing the flange-connection between the rabble arm and the connecting branch. This requires of course that the MHF is first cooled down prior to exchanging the rabble arm.

BRIEF SUMMARY OF THE INVENTION

The invention provides a MHF with a compact system for connecting the rabble arms to the vertical rotary shaft, which warrants that the rabble arms are reliably secured to the rotary shaft but can nevertheless be easily exchanged, and in which the rabble arm securing means are relatively well protected against mechanical deformations and overheating of the rabble arm.

The invention proposes a MHF comprising a vertical rotary hollow shaft with at least one rabble arm. This at least one rabble arm includes a tubular structure for circulating therethrough a cooling fluid and a coupling end that is received in a socket arranged in an arm fixing node of the vertical rotary hollow shaft. This coupling end includes at least one cooling fluid supply channel and at least one cooling fluid return channel therein. A securing means is provided for securing the rabble arm with its coupling end in the socket. This securing means includes a clamping bolt for pressing the plug body into the socket. The clamping bolt protrudes out of the coupling end of the rabble arm, where it has a bolt head that can be brought by rotation of the clamping bolt about its central axis into and out of hooking engagement with an abutment surface on the arm fixing node. A threaded sleeve is screwed onto a threaded end of the clamping bolt for exerting a clamping force onto the clamping bolt. In accordance with one aspect of the present invention, the coupling end is formed by a solid plug body, which is connected to the tubular structure of the rabble arm and has a front end and a rear end. A through boring extends axially from the front end to the rear end, wherein the at least one cooling fluid supply channel and the at least one cooling fluid return channel are arranged in the plug body around the through boring. The clamping bolt is rotatably fitted in the through boring and its threaded end sticks out of the through boring at the rear end of the plug body. The threaded sleeve, which is screwed onto the threaded end, bears on an abutment surface at the rear end of the plug body for exerting the clamping force onto the clamping bolt. The tubular structure of the rabble arm comprises an arm support tube, which is connected to the rear end of the plug body, and a gas guiding tube, which is arranged inside the arm support tube and cooperates with the latter to define between them a small annular cooling gap for channelling the cooling gas from the shaft to the free end of the rabble arm. The interior section of the gas guiding tube forms a return channel for the cooling gas. The cooling fluid supply and return means include at least one cooling fluid supply channel and at least one cooling fluid return channel arranged in the solid plug body around the through boring. At the rear end of the solid plug body, the at least one cooling fluid supply channel is in communication with the small annular cooling gap, and the at least one cooling fluid return channel is in communication with the return channel.

A preferred embodiment of the bolt head has for example the form of a hammer head defining a shoulder surface on each side of the shank, wherein the hammer head bears with both shoulder surfaces against the abutment surface on the rabble arm fixing node. However the bolt head may of course also have the form of a simple hook defining only a single shoulder surface. It may also have a more complicated form, provided that it is still capable of being brought by rotation of the clamping bolt about its central axis into and out of hooking engagement with an abutment surface on the arm fixing node.

For easily tightening or loosening of the threaded sleeve bearing on the abutment surface at the rear side of the plug body and for easily checking that it has e.g. not loosened, the securing means further comprises an actuation tube secured with a first end to the threaded sleeve and extending through the entire rabble arm up to the free end of the latter, where its second end supports a coupling head for coupling thereto an actuation key for transmitting a torque to the threaded sleeve via the actuation tube. Alternatively, the coupling head for coupling thereto an actuation key could be directly secured to the threaded sleeve, i.e. without actuation tube permanently secured to the threaded sleeve. This alternate solution would however make more difficult coupling an actuation key to the sleeve and checking that the threaded sleeve is sufficiently tightened.

The clamping bolt is advantageously connected to a positioning tube extending through the entire rabble arm up to the free end of the latter. The positioning tube allows to easily position the clamping bolt, to hold the latter in place when a torque is exerted onto the threaded sleeve and to check the angular position of the bolt head. The positioning tube is advantageously co-axial to and rotatably supported within the actuation tube, i.e. it takes no further place within the tubular structure of the rabble arm.

The tubular structure of the rabble arm normally includes an arm support tube, wherein the plug body is connected to one end of the arm support tube and its other end is closed by an end-cup. The actuation tube then axially extends through the arm support tube and its free end is rotatably supported in a sealed manner in a through hole of the end-cup. This arrangement allows e.g. to visually inspect the position of the coupling head of the actuation and positioning tube, without gas leakage through the front end of the arm.

Instead of having a tubular coupling end, as in all prior art rabble arms, the rabble arm has solid plug body that is advantageously a cast body secured to the tubular structure of the rabble arm, wherein the hole in which the cylindrical shank portion is fitted and the at least one cooling fluid supply channel and the at least one cooling fluid return channel are provided as bores in said solid cast body (comprising straight through bores and composite bores). It will be appreciated that such a plug body, which can be manufactured without necessitating complicated casting moulds, is a particularly compact, strong and reliable connection means for connecting the rabble arm to the vertical rotary shaft.

In a preferred embodiment of the MHF, the socket has therein a first or inner concave conical seat surface located in proximity of its bottom surface and a concave cylindrical guiding surface located closer to the entrance opening of the socket, and the plug body has thereon a first convex conical counter-seat surface and a convex cylindrical guiding surface cooperating with said concave conical seat surface, respectively said concave cylindrical guiding surface in the socket. More particularly, the cylindrical guiding surfaces cooperate with one another for guiding the plug body of the rabble arm axially into and out of a position in which the plug body sits with its first convex conical counter-seat surface on the first concave conical seat surface. It will be appreciated that axial guidance provided by the two cylindrical guiding surfaces and considerably reduces the risk of damaging the plug body or the socket during the final coupling operation. When the plug body sits in its socket, its first convex conical counter-seat cooperates with the first concave conical seat surface to provide a first sealing function between the plug body and the socket near the bottom of the socket. This first sealing function allows e.g. to provide a cooling gas connection in the front end of the plug body.

The socket has advantageously therein a second or outer concave conical seat surface, the concave cylindrical guiding surface lying between the first concave conical seat surface and the second concave conical seat surface. The plug body has then thereon a second convex conical counter-seat surface, the convex cylindrical guiding surface lying between the first convex conical counter-seat surface and the second convex conical counter-seat surface. During introduction of the plug body into the socket, the outer concave conical seat surface first guides the plug body into axial alignment with the cylindrical guiding surface. When the plug body sits in its socket, its second convex conical counter-seat cooperates with the second concave conical seat surface to provide a second sealing function between the plug body and the socket near the entrance of the socket. This second sealing function allows e.g. to provide a cooling sealed gas connection in the cylindrical guiding surfaces.

Thus, with the configuration described in the preceding paragraph, at least one cooling gas channel is advantageously arranged in the rabble arm fixing node that has an opening in the concave cylindrical guiding surface; and at least one cooling gas channel is then arranged in the plug body of the rabble arm that has an opening in the convex cylindrical guiding surface, wherein the openings are overlapping when the plug body is seated on its seats in the socket.

The rabble arm fixing node comprises advantageously a ring-shaped cast body made of refractory steel, the sockets being radially arranged in the ring-shaped cast body. It will be appreciated that such a rabble arm fixing node is a particularly compact, strong and reliable connection means for connecting the rabble arm to the vertical rotary shaft.

The shaft advantageously includes a support structure consisting of the rabble arm fixing nodes and of intermediate support tubes that are interposed as structural load carrying members between the rabble arm fixing nodes described in the preceding paragraph. The rabble arm fixing nodes and the intermediate support tubes are preferably assembled by welding. It will be appreciated that such a shaft can be easily manufactured at relatively low costs using standardized elements. It provides however a strong, long-lasting support structure that has a very good resistance with regard to temperature and corrosive agents in the hearth chambers.

At least one section of the shaft extending between two adjacent hearth chambers comprises: a intermediate support tube fixed between two arm fixing nodes to form an outer shell; an intermediate gas guiding jacket arranged within the intermediate support tube so as to delimit an annular main cooling gas supply channel between both; and an inner gas guiding jacket arranged within the intermediate support tube so as to delimit annular main cooling gas distribution channel between both, the inner gas guiding jacket further defining the outer wall of a central exhaust channel. Such a shaft section with three concentric passages for the cooling gas, warrants an excellent cooling of the outer wall of the shaft section, i.e. the load bearing intermediate support tube. The latter forms indeed the outer wall of the main cooling gas supply channel, through which the whole cooling gas supply flow is channeled before it is distributed on the rabble arms.

The arm fixing node advantageously comprises a ring-shaped cast body including: at least one of the sockets for receiving therein the plug body of the rabble arm; a central passage forming the central exhaust channel for the cooling gas within the arm fixing node; first secondary passages arranged in a first ring section of the cast body, so as to provide gas passages for cooling gas flowing through the annular main cooling gas distribution channel; second secondary passages arranged in a second ring section of the cast body, so as to provide gas passages for cooling gas flowing through the annular main cooling gas supply channel; a first channel means arranged in the cast body, so as to interconnect the annular main cooling gas supply channel with a gas outlet opening within the at least one socket; and a second channel means arranged in the cast body, so as to interconnect a gas inlet opening within the at least one socket with the central passage. The first channel means advantageously comprises at least one oblique bore extending through the ring-shaped cast body from the second ring section into a lateral surface delimiting the socket. The second channel means advantageously comprises a through hole in axial extension of the socket. This embodiment of an arm fixing node combines a low pressure drop cooling gas distribution in the shaft and a solid fixing of the rabble arm on the shaft with a very compact and cost saving design. With its integrated gas passages, it substantially contributes to the fact that the vertical rotary shaft, which includes three co-axial cooling channels therein, can be manufactured using a very small number of standardized elements. It also essentially contributes to warranting a strong, long-lasting shaft support structure with a very good resistance with regard to temperature and corrosive agents in the hearth chambers.

A micro porous thermal insulation layer is advantageously arranged on the arm support tube; and a metallic protecting jacket is covering the micro porous thermal insulation. Metallic rabble teeth are in this configuration advantageously directly welded to the metallic protecting jacket, wherein anti-rotation means are then arranged between the arm support tube and the metallic protecting jacket.

BRIEF DESCRIPTION OF THE DRAWINGS

Further details and advantages of the present invention will be apparent from the following detailed description of a preferred but not limiting embodiment with reference to the attached drawings, wherein.

DETAILED DESCRIPTION OF THE INVENTION

Figure 1:
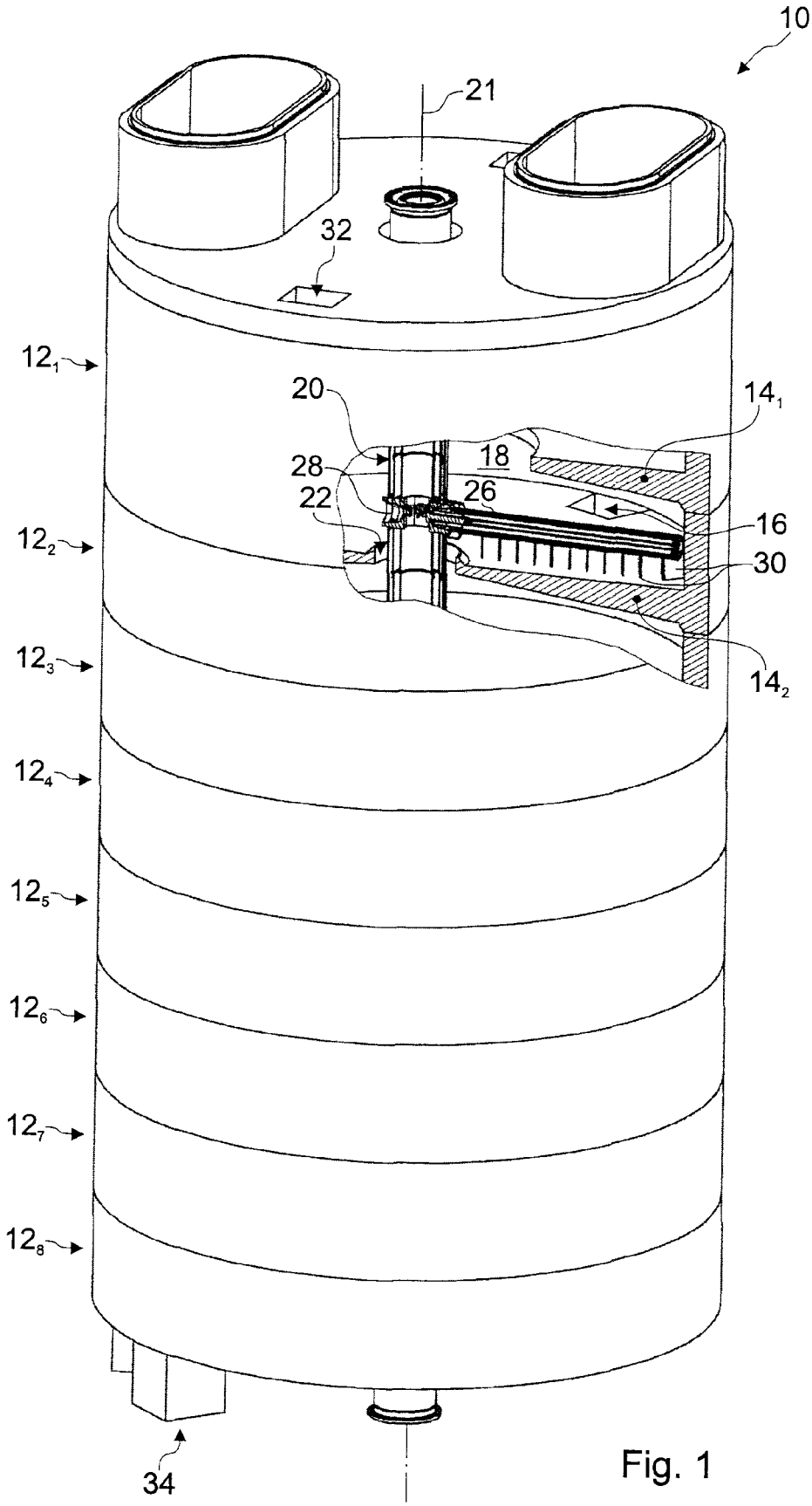
FIG. 1 is three dimensional view of a multiple hearth furnace in accordance with the invention, with a partial section.

FIG. 1 shows a multiple hearth or roasting furnace 10. Both the construction and operation of such a multiple hearth furnace (MHF) 10 are known in the art and are therefore described herein only as far as they are relevant for the illustration of the inventions claimed herein.

The MHF as shown in FIG. 1 is basically a furnace including several hearth chambers 12 arranged one on top of the other. The MHF shown in FIG. 1 includes e.g. eight hearth chambers numbered $\mathbf{12}_1$, $\mathbf{12}_2$ . . . $\mathbf{12}_8$. Each hearth chamber 12 includes a substantially circular hearth 14 (see e.g. $\mathbf{14}_1$, $\mathbf{14}_2$). These hearths 14 alternately have either several peripheral material drop holes 16 along their outer periphery, such as e.g. hearth $\mathbf{14}_2$, or a central material drop hole 18, such as e.g. hearth $\mathbf{14}_1$.

Reference number 20 identifies a vertical rotary hollow shaft coaxially arranged with the central axis 21 of the furnace 10. This shaft 20 passes through all hearth chambers 12, wherein a hearth without central material drop hole 18—such as e.g. hearth $\mathbf{14}_2$ in FIG. 1—has a central shaft passage opening 22 to allow the shaft 20 to freely extend therethrough. In a hearth with a central material drop hole 18—such as e.g. hearth $\mathbf{14}_1$ in FIG. 1—the shaft 20 extends through the central material drop hole 18. It will be noted in this context that the central material drop hole 18 has a much bigger diameter than the shaft 20, so that the central material drop hole 18 is indeed an annular opening around the shaft 20.

Both ends of the shaft 20 comprise a shaft end with a journal rotatably supported in a bearing (not shown in FIG. 1). Rotation of the shaft 20 about its central axis 21 is accomplished by means of a rotary drive unit (not shown in FIG. 1). As such a rotary drive unit for the shaft 20 as well as shaft bearings are known in the art and furthermore not relevant for the understanding of the inventions claimed herein, they will not be described with greater detail hereinafter.

FIG. 1 also shows a rabble arm 26 that is secured in hearth chamber $\mathbf{12}_2$ to a rabble arm fixing node 28 on the shaft 20. Such an arm fixing node 28 is principally arranged in every hearth chamber 12, wherein it normally supports more than one rabble arm 26. In most MHFs, such an arm fixing node 28 normally supports four rabble arms 26, wherein the angle between two successive rabble arms 26 is 90°. Each rabble arm 26 includes a plurality of rabble teeth 30. These rabble teeth 30 are designed and arranged so as to move material on the hearth either towards its center or towards its periphery when the shaft 20 is rotated. In a hearth chamber with peripheral material drop holes 16 in its hearth 14, such as e.g. hearth chamber $\mathbf{12}_2$, these rabble teeth 30 are designed and arranged so as to move material on the hearth 14 towards the peripheral material drop holes 16 when the shaft 20 is rotated. In a hearth chamber with a central material drop hole 18 in its hearth 14, such as e.g. hearth chamber $\mathbf{12}_1$, these rabble teeth 30 are however designed and arranged so as to move the material on the hearth 14 towards the central material drop hole 18 when the shaft 20 is rotated in the same direction.

Now follows a brief description of material flow through the MHF 10. In order to heat or roast material within the MHF 10, this material is discharged from a conveying system (not shown) through a furnace charging openings 32 into the uppermost hearth chamber $\mathbf{12}_1$ of the MHF. In this chamber $\mathbf{12}_1$ material falls onto the hearth $\mathbf{14}_1$, which has a central material drop hole 18. As the shaft 20 is continuously rotated, the four of rabble arms 26 in the hearth chamber $\mathbf{12}_1$ push the material with their rabble teeth 30 over the hearth $\mathbf{14}_1$ towards and into its central material drop hole 18. Through the latter material falls onto the hearth $\mathbf{14}_2$ of the next hearth chamber $\mathbf{12}_2$. Here, the rabble arms 26 push the material with their rabble teeth 30 over the hearth $\mathbf{14}_2$ towards and into its peripheral material drop holes 16. Through the latter, material falls onto the next hearth (not shown in FIG. 1) that has again a central material drop hole 18. In this way, material entering the MHF 10 through the furnace charging opening 32 is passed over all eight hearths $\mathbf{14}_1 \ldots \mathbf{14}_8$ by the rotating the rabble arms 26. Arrived in the lowermost hearth chamber $\mathbf{12}_8$, the roasted or heated material finally leaves the MHF 10 through a furnace discharging opening 34.

As known in the art, both the shaft 20 and the rabble arms 26 have internal channels through which is circulated a gaseous cooling fluid, usually pressurized air, which will be called hereinafter for the sake of simplicity "cooling gas". The object of this gas cooling is to protect the shaft 20 and the rabble arms 26 against damage due to the elevated temperatures in the hearth chambers 12. Indeed, in the hearth chambers 12 ambient temperature may be as high as 1000° C.

Figure 2:
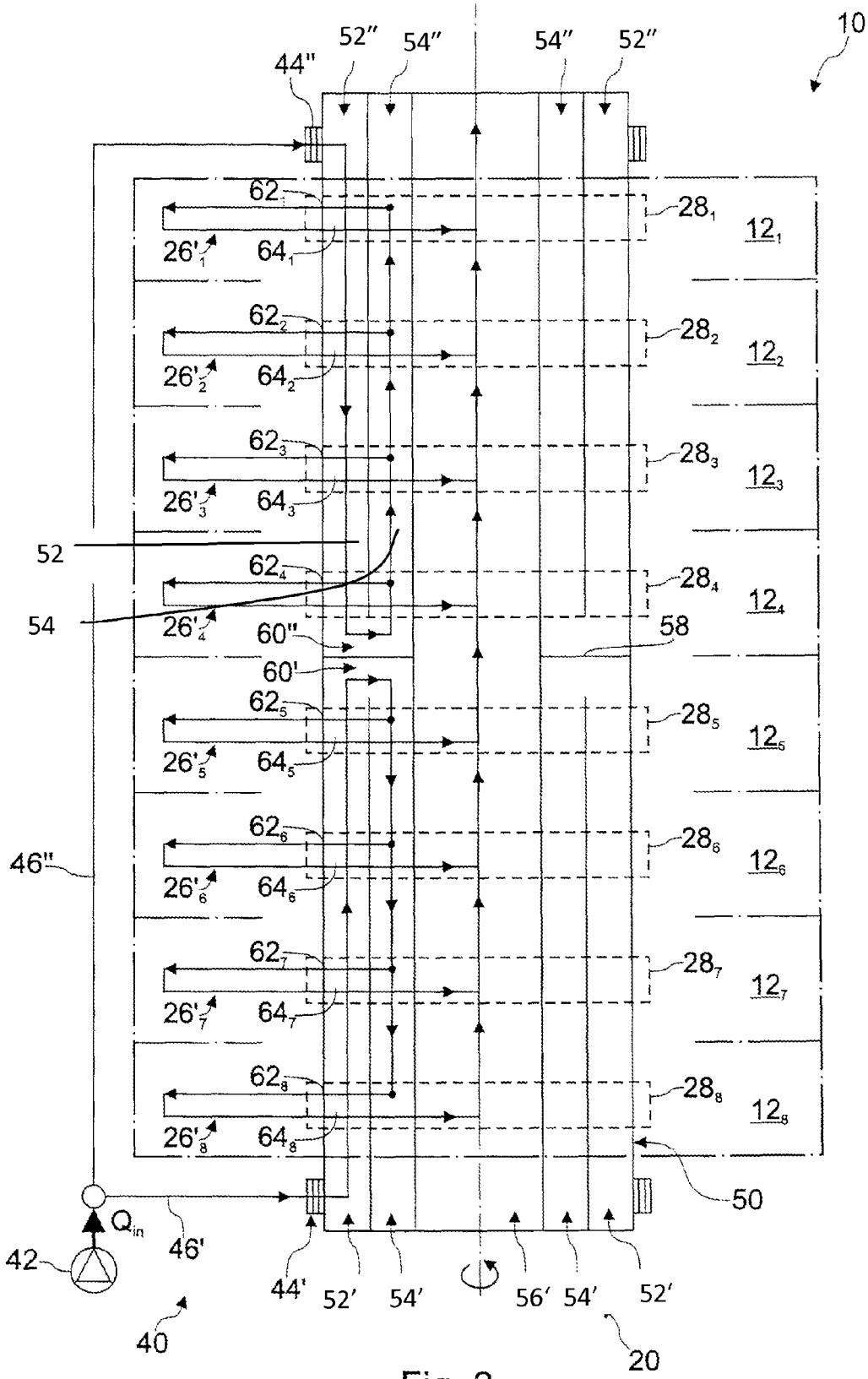
FIG. 2 is schematic diagram illustrating the flow of cooling gas through the rotary hollow shaft and the rabble arms.

The flow diagram of FIG. 2 gives a schematic overview of a new and particularly advantageous gas cooling system 40 for the shaft 20 and the rabble arms 26. The big dashed rectangle 10 schematically represents the MFH 10 with its eight hearth chambers $\mathbf{12}_1 \ldots \mathbf{12}_8$. A schematic representation of the rotary hollow shaft 20 illustrates the flow paths of the cooling gas within the shaft 20. Reference numbers $\mathbf{26'}_1 \ldots \mathbf{26'}_8$ identify in each hearth chamber $\mathbf{12}_1 \ldots \mathbf{12}_8$, a schematic representation of the cooling system of a rabble arm arranged in the respective hearth chamber. The small dashed rectangles $\mathbf{28}_1 \ldots \mathbf{28}_8$ are schematic representations of the rabble arm fixing nodes in the shaft 20.

Reference number 42 in FIG. 2 identifies a cooling gas supply source, e.g. a fan pressurizing ambient air. As is known in the art, the fan 42 is connected by means of a lower cooling gas supply line 46' to a lower cooling gas inlet 44' of the shaft 20. This lower cooling gas inlet 44' is arranged outside the furnace 10 below of the lowermost hearth chamber $\mathbf{12}_8$. However, in the MHF of FIG. 2, the fan 42 is also connected by means of an upper cooling gas supply line 46" to an upper cooling gas inlet 44" of the shaft 20. This upper cooling gas inlet 44" is arranged outside the furnace 10 above the uppermost hearth chamber $\mathbf{12}_1$. It follows that the flow rate from the fan 42 is split between the lower cooling gas inlet 44', to be supplied to lower half of the shaft 20, and the upper cooling gas inlet 44", to be supplied to upper half of the shaft 20. It remains to be noted that—as the shaft 20 is a rotary shaft—both cooling gas inlets 44' and 44" must be rotary connections. As such rotary connections are known in the art and as their design is furthermore not relevant for the understanding of the inventions claimed herein, the design of the upper and lower cooling gas inlets 44', 44" will not be described with greater detail hereinafter.

The shaft 20 includes three concentric cooling gas channels within an outer shell 50. The outermost channel is an annular main cooling gas supply channel 52 in direct contact with the outer shell 50 of the shaft 20. This annular main supply channel 52 surrounds an annular main distribution channel 54, which finally surrounds a central exhaust channel 56.

It will be noted that between hearth chambers $\mathbf{12}_4$ and $\mathbf{12}_5$, i.e. approximately in the middle of the shaft 20, a partition means, as e.g. a partition flange 58, partitions the annular main supply channel 52 and the annular main distribution channel 54 in a lower half and an upper half. This partitioning does however not affect the central exhaust channel 56, which extends from the lowermost hearth chamber $\mathbf{12}_8$ through all hearth chambers $\mathbf{12}_8$ to $\mathbf{12}_1$ to the top of the shaft 20. If it is necessary hereinafter to make a distinction between the lower and upper half of the annular main supply channel 52, respectively between the lower and upper half of the annular main distribution channel 54, the lower half will be identified with the superscript (') and the upper half with the superscript (").

The lower cooling gas inlet 44' is directly connected to the lower half 52' of the annular main supply channel 52. The cooling gas supplied to the lower cooling gas inlet 44' consequently enters beneath the lowermost hearth chamber $\mathbf{12}_8$ into the lower annular main supply channel 52' and is then channeled through the latter up to the partition flange 58 between hearth chambers $\mathbf{12}_5$ and $\mathbf{12}_4$, wherein the flow rate of the cooling gas remains unchanged over the whole length of the lower annular main supply channel 52'. This constant flow rate of cooling gas over the whole length of the lower annular main supply channel 52' warrants that the outer shell 50 of the shaft 20 is efficiently cooled in the four lower hearth chambers $\mathbf{12}_8 \ldots \mathbf{12}_5$.

Just below the partition flange 58, there is a lower cooling gas passage 60' between the lower annular main supply channel 52' and the lower annular main distribution channel 54'. Through this lower cooling gas passage 60', the cooling gas enters into the lower annular main distribution channel 54'. Via at least one cooling gas supply channel $\mathbf{62}_5 \ldots \mathbf{62}_8$ in its rabble arm fixing node $\mathbf{28}_5 \ldots \mathbf{28}_8$ each rabble arm cooling system $\mathbf{26'}_5 \ldots \mathbf{26'}_8$ in the lower half of the MHF 10 is in direct communication with the lower annular main distribution channel 54'. Via at least one cooling gas exhaust channel $\mathbf{64}_5$ . . . $\mathbf{64}_8$ in its rabble arm fixing node $\mathbf{28}_5$ . . . $\mathbf{28}_8$, each rabble arm cooling system $\mathbf{26'}_5$ . . . $\mathbf{26'}_8$ in the lower half of the MHF 10 is also in direct communication with the central exhaust channel 56. Consequently, in the rabble arm fixing node $\mathbf{28}_5$, a secondary cooling gas flow is branched off from the main cooling gas flow in the lower main distribution channel 54' and rerouted through the rabble arm cooling system $\mathbf{26'}_5$ to be thereafter directly evacuated into the central exhaust channel 56. In the rabble arm fixing node $\mathbf{28}_6$, another part of the gas flow in the annular main distribution channel 54' passes through the rabble arm cooling system $\mathbf{26'}_6$ and is thereafter also evacuated into the central exhaust channel 56. Finally, in the last rabble arm fixing node $\mathbf{28}_8$, all the remaining gas flow in the lower main distribution channel 54' passes through the rabble arm cooling system $\mathbf{26'}_8$ and is thereafter evacuated into the central exhaust channel 56.

The flow system in the upper half of the shaft 20 is very similar to the flow system described above. The upper cooling gas inlet 44" is directly connected to the upper half 52" of the annular main supply channel 52. The cooling gas supplied to the upper cooling gas inlet 44" consequently enters into the upper annular main supply channel 52" above the uppermost hearth chamber $\mathbf{12}_1$ and is then channeled through the latter down to the partition flange 58 between hearth chambers $\mathbf{12}_4$ and $\mathbf{12}_5$, wherein the flow rate of the cooling gas remains unchanged over the whole length of the upper annular main supply channel 52". This constant flow rate of cooling gas over the whole length of the upper annular main supply channel 52' warrants that the outer shell 50 of the shaft 20 is efficiently cooled in the four upper hearth chambers $\mathbf{12}_1$ . . . $\mathbf{12}_4$.

Just above the partition flange 58, there is an upper cooling gas passage 60" between the upper main supply channel 52" and the upper annular main distribution channel 54". Through this upper cooling gas passage 60", the cooling gas enters into the upper main distribution channel 54". The connection of each rabble arm cooling system $\mathbf{26'}_4$ . . . $\mathbf{26'}_1$ in the upper half of the furnace 10 to the upper main distribution channel 54" and the central exhaust channel 56 is as described above for rabble arm cooling systems $\mathbf{26'}_4$ . . . $\mathbf{26'}_1$ in the lower half. Consequently, in the rabble arm fixing node $\mathbf{28}_4$, a secondary cooling gas flow is branched off from the main cooling gas flow in the upper main distribution channel 54" and rerouted through the rabble arm cooling system $\mathbf{26'}_4$ to be thereafter directly evacuated into the central exhaust channel 56. In the rabble arm fixing node $\mathbf{28}_3$ another part of the gas flow in the upper main distribution channel 54" passes through the rabble arm cooling system $\mathbf{26'}_3$ and is thereafter also evacuated into the central exhaust channel 56. Finally, in the uppermost rabble arm fixing node $\mathbf{28}_1$ all the remaining gas flow in the upper main distribution channel 54" passes through the rabble arm cooling system $\mathbf{26'}_1$ and is thereafter evacuated into the central exhaust channel 56. From the central exhaust channel 56 the exhaust gas stream is then either directly evacuated into the atmosphere or evacuated by means of a rotary connection into a pipe for a controlled evacuation of the gas (not shown).

Figure 3:
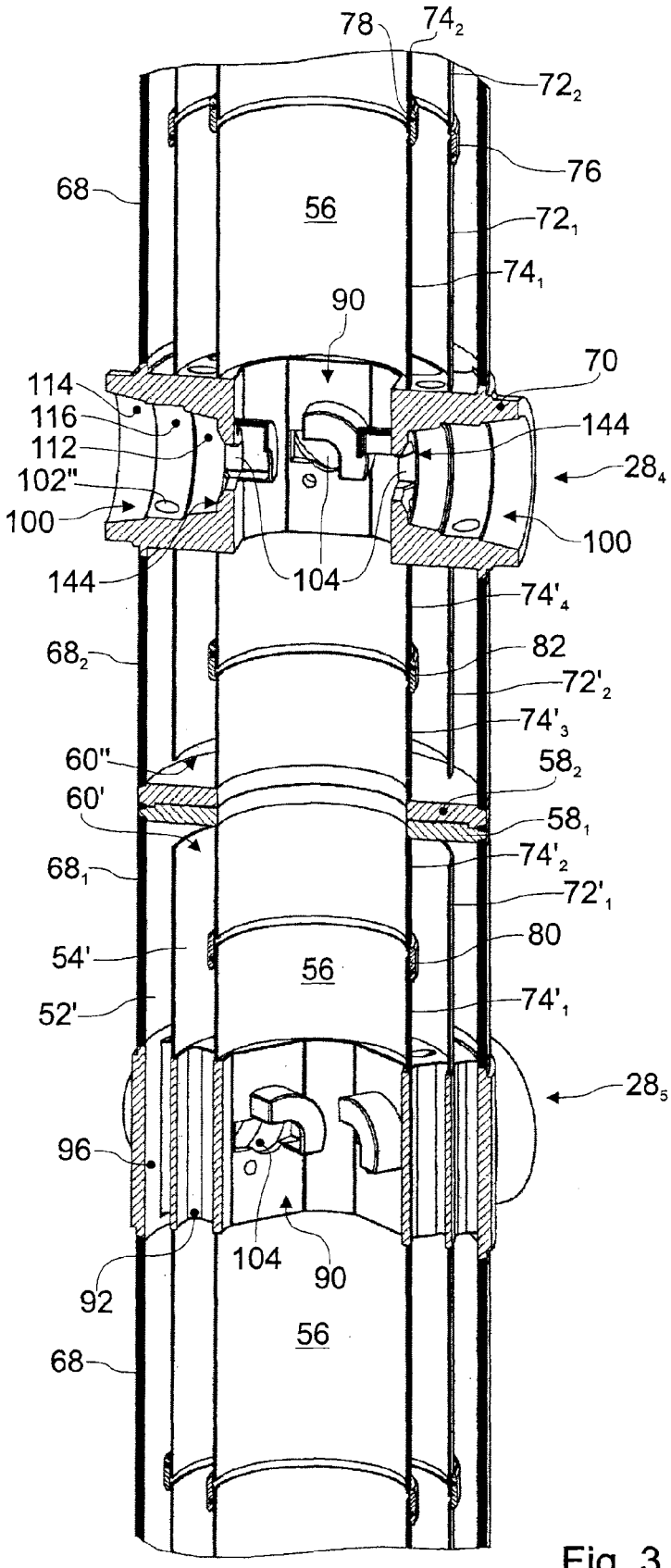
FIG. 3 is a section through a rotary hollow shaft, drawn as a three dimensional view.

FIG. 3 illustrates a particularly advantageous embodiment of the rotary hollow shaft 20 of the furnace. This FIG. 3 shows more particularly a longitudinal section through the central part of shaft 20. This central part includes the aforementioned partition flange 58, which partitions the annular main supply channel 52 and the annular main distribution channel 54 in a lower half 52', 54' and an upper half 52", 54".

The outer shell 50 of the shaft consists mainly of intermediate support tubes 68 interconnected by the rabble arm fixing node 28. Such a rabble arm fixing node 28 comprises a ring-shaped cast body 70 made of refractory steel. The intermediate support tubes 68 are made of thick walled stainless steel tubes and are dimensioned as structural load carrying members between successive rabble arm fixing nodes 28. The intermediate support tubes 68 interconnected by massive rabble arm fixing nodes 28 constitute the load bearing structure of the shaft 20, which supports the rabble arms 26 and allows to absorb important torques when the rabble arms 26 are pushing the material over the hearths 14. It will further be noted that—in contrast to prior art shafts—the outer shell 50 described herein is advantageously a welded structure, the ends of the intermediate support tubes 68 are welded to the rabble arm fixing nodes 28, instead of being flanged thereon.

As explained above, the section of the shaft extending between adjacent hearth chambers $\mathbf{12}_4$ and $\mathbf{12}_5$ (i.e. the central shaft section) is rather particular because it comprises the partitioning flange 58, as well as the cooling passages 60', 60" between the annular main supply channel 52 and the annular main distribution channel 54. Before describing this particular central shaft section, a "normal" shaft section will now be described, also with reference to FIG. 3. Such a "normal" shaft section extending between two other adjacent hearth chambers, as e.g. hearth chambers $\mathbf{12}_3$ and $\mathbf{12}_4$, comprises the intermediate support tube 68 welded between two arm fixing nodes $\mathbf{28}_3$ and $\mathbf{28}_4$ to form the outer shell 50 of the shaft 20. The intermediate support tube 68 also delimits the annular main supply channel 52 to the outside, which warrants a very good cooling of the intermediate support tube 68. An intermediate gas guiding jacket 72 is arranged within the intermediate support tube 68 so as to delimit the annular main supply 52 channel to the inside and the annular main distribution channel 54 to the outside. An inner gas guiding jacket 74 is arranged within the intermediate gas guiding jacket 72 so as to delimit the annular main distribution channel 54 to the inside and the central exhaust channel 56 to the outside. The intermediate gas guiding jacket 72 comprises a first tube section $\mathbf{72}_1$ and a second tube section $\mathbf{72}_2$. The first tube section $\mathbf{72}_1$ is welded with one end to the fixing node $\mathbf{28}_4$. The second tube section $\mathbf{72}_2$ is similarly welded with one end to the fixing node $\mathbf{28}_3$ (not shown in FIG. 3). The first tube section $\mathbf{72}_1$ and the second tube section $\mathbf{72}_2$ have opposite free ends that are arranged opposite one another. A sealing sleeve 76 is fixed to the free end of first tube section $\mathbf{72}_1$ and sealingly engaging the free end of the second tube section $\mathbf{72}_2$, while simultaneously tolerating relative movement of both tube sections $\mathbf{72}_1$ and $\mathbf{72}_2$ in the axial direction. It follows that an expansion joint is formed in the intermediate gas guiding jacket 72. This expansion joint allows to compensate for differences in thermal expansion of the intermediate support tube 68 and the intermediate gas guiding jacket 72, because the latter remains generally cooler than the intermediate support tube 68. The inner gas guiding jacket 74 similarly comprises a first tube section $\mathbf{74}_1$ and a second tube section $\mathbf{74}_2$. The first tube section $\mathbf{74}_1$ is welded with one end to the fixing node $\mathbf{28}_4$. The second tube section $\mathbf{74}_2$ is similarly welded with one end to the fixing node $\mathbf{28}_3$ (not shown in FIG. 3). The first tube section $\mathbf{74}_1$ and the second tube section $\mathbf{74}_2$ have opposite free ends that are arranged in opposite one another. A sealing sleeve 78 is fixed to the free end of first tube section $\mathbf{74}_1$ and sealingly engaging the free end of the second tube section $\mathbf{74}_2$, while tolerating relative movement of both tube sections $\mathbf{74}_1$ and $\mathbf{74}_2$ in the axial direction. It follows that an expansion joint is formed in the inner gas guiding jacket 74. This expansion joint allows to compensate for differences in thermal expansion of the intermediate support tube 68 and the inner gas guiding jacket 74, which remains generally cooler than the intermediate support tube 68. It will furthermore be appreciated that the solution with the two sealing sleeves 76, 78 renders assembling by welding of the shaft sections much easier.

As can be seen in FIG. 3, the section of the shaft extending between adjacent hearth chambers $\mathbf{12}_4$ and $\mathbf{12}_5$ distinguishes from the "normal" section described in the preceding paragraph by several features. The intermediate support tube 68 consists e.g. of two halves $\mathbf{68}_1$ and $\mathbf{68}_2$ that are assembled at the level of the partition flange 58 (in fact, each tube half $\mathbf{68}_1$ and $\mathbf{68}_2$ includes a terminal ring flange $\mathbf{58}_1$ and $\mathbf{58}_2$ and both ring flanges $\mathbf{58}_1$ and $\mathbf{58}_2$ are welded together). The intermediate jacket 72' simply consists of two tube sections $\mathbf{72'}_1$ and $\mathbf{72'}_2$, wherein a first end of each tube section $\mathbf{72'}_1$ and $\mathbf{72'}_2$ is welded to one of both arm fixing nodes $\mathbf{28}_3$ and $\mathbf{28}_4$, and the second end is a free end spaced apart from the partitioning flange 58 to define the gas passages 60' and 60" between the lower annular main supply channel 52' and the lower annular main distribution channel 54', respectively the upper annular main supply channel 52" and the upper annular main distribution channel 54". The inner jacket 74' consists of four tube sections $\mathbf{74'}_1$, $\mathbf{74'}_2$, $\mathbf{74'}_1$, $\mathbf{74'}_2$, wherein the first tube section $\mathbf{74'}_1$ is welded with one end to the arm fixing node $\mathbf{28}_4$, the second tube section $\mathbf{74'}_2$ is welded with one end to the flange $\mathbf{58}_1$, the third tube section $\mathbf{74'}_3$ is welded with one end to the flange $\mathbf{58}_2$ and the fourth tube section $\mathbf{74'}_4$ is welded with one end to the arm fixing node $\mathbf{28}_3$. A first sealing sleeves 80 provides a sealed connection and axial expansion joint between the opposite free ends of the first tube section $\mathbf{74'}_1$ and the second tube section $\mathbf{74'}_2$. A second sealing sleeves 82 provides a sealed connection and axial expansion joint between the opposite free ends of the third tube section $\mathbf{74'}_3$ and the fourth tube section $\mathbf{74'}_4$. The sealing sleeves 80 and 82 just work as the sealing sleeves 76 and 78 and render assembling of the central shaft section much easier.

To complete thermal protection of the shaft 20, the latter is advantageously recovered with a thermal insulation (not shown). Such an insulation of the shaft 20 is advantageously a multilayer insulation including e.g. an inner refractory layer of micro-porous material, a thicker intermediate refractory layer of insulating castable material and an even thicker outer refractory layer of dense castable material.

Figure 4:
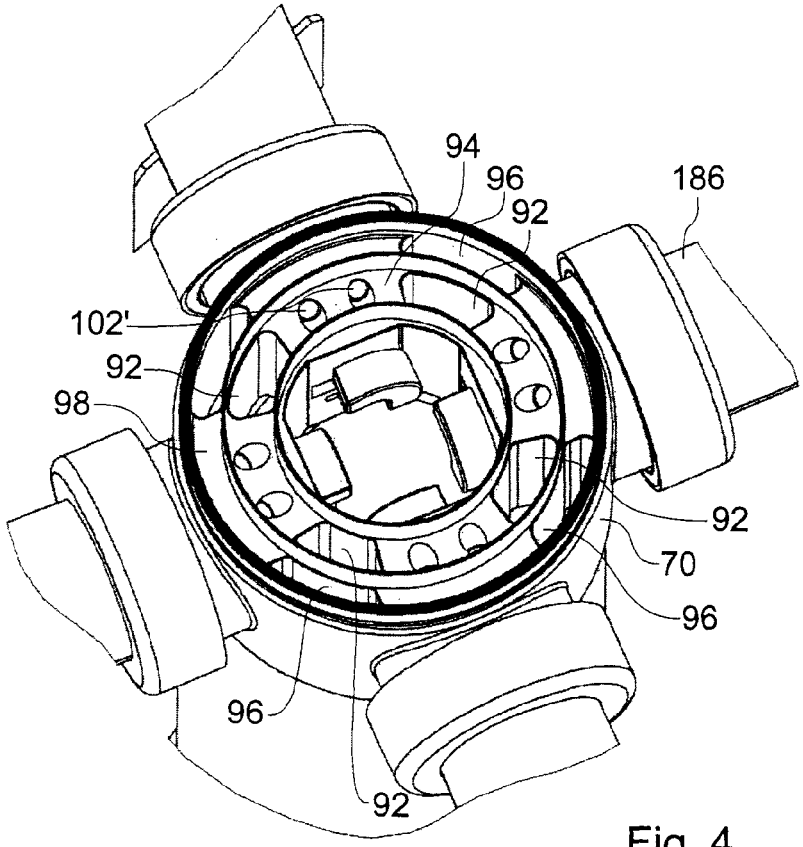
FIG. 4 is three dimensional view of a rabble arm fixing node, with four rabble arms fixed thereto.

A preferred embodiment of a rabble arm fixing node 28 is now describe with reference to FIG. 3 and FIG. 4. As said already above, the rabble arm fixing node 28 comprises a ring-shaped cast body 70 made of refractory steel. The central passage 90 in this ring shaped body 70 forms the central exhaust channel 56 for the cooling gas within the rabble arm fixing node 28. First secondary passages 92 are arranged in a first ring section 94 of the ring shaped body 70 around the central passage 90, so as to provide gas passages for cooling gas flowing through the annular main distribution channel 54. Second secondary passages 96 are arranged in a second ring section 98 of the ring shaped body 70 around the first ring section 94, so as to provide gas passages for cooling gas flowing through the annular main supply channel 52. For each rabble arm 26 to be connected to rabble arm fixing node 28, the ring shaped body 70 includes furthermore a socket 100, i.e. a cavity extending radially into the ring shaped body 70 between the aforementioned first and second secondary passages 92 and 96. The rabble arm fixing node 28 includes four sockets 100, wherein the angle between the central axis of two consecutive sockets 100 is 90°. Oblique bores 102 in the ring shaped body 70 (see FIG. 5), which have an inlet opening 102' in the second ring section 98 of the ring shaped body 70 and an outlet opening 102" in a lateral surface of the socket 100, form the cooling gas supply channels 62, which have already been mentioned within the context of the description of FIG. 3. A through hole 104 in the ring shaped body 70, in axial extension of the socket 100, forms the cooling gas return channel 64, which has already been mentioned within the context of the description of FIG. 3.

Figure 5:
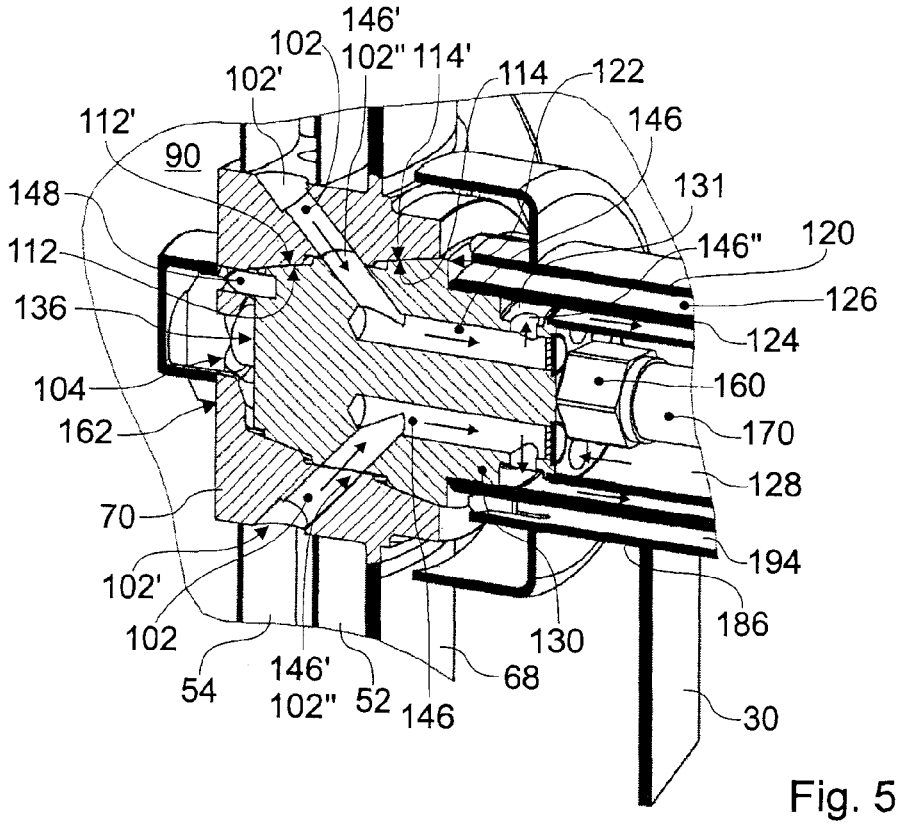
FIG. 5 is a first section through a socket in a rabble arm fixing node with a plug body of a rabble arm received therein (the section is drawn as a three dimensional view)
Figure 6:
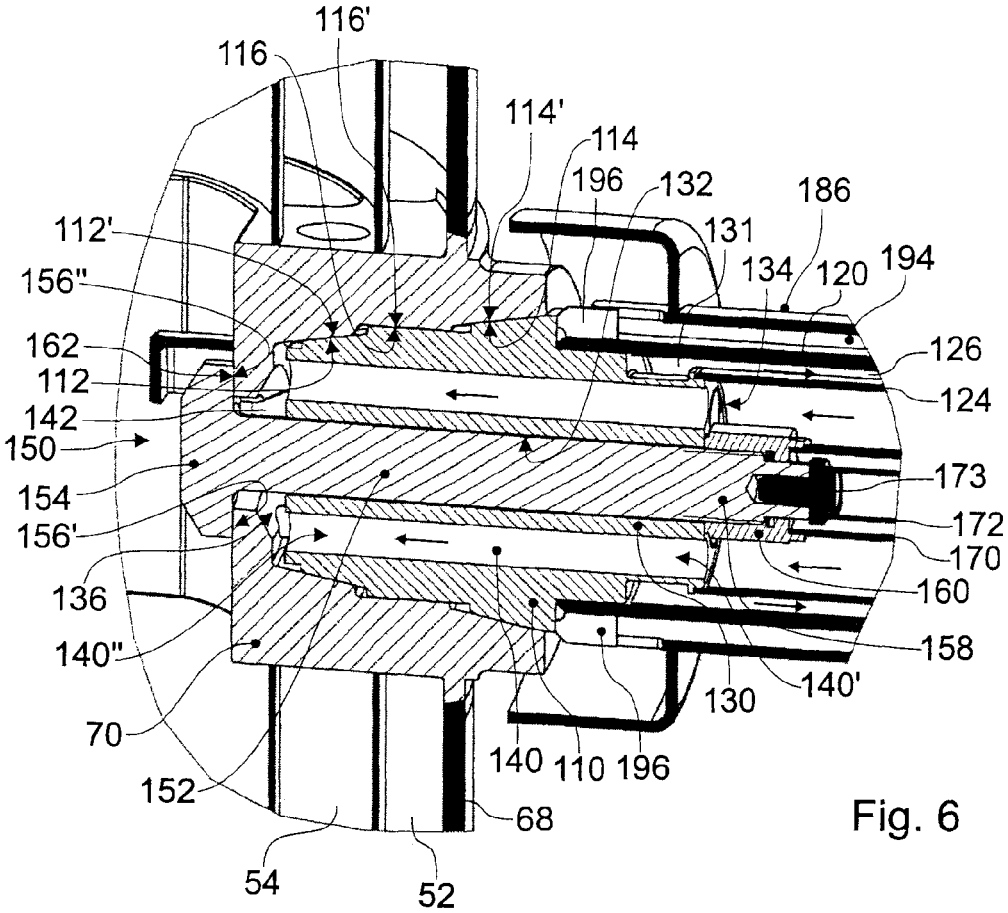
FIG. 6 is a second section through a socket in a rabble arm fixing node with a plug body of a rabble arm received therein (the section is drawn as a three dimensional view)

Considering now more particularly FIG. 3, FIG. 5 and FIG. 6, it will first be noted that the rabble arm 26 includes a plug body 110 that form a coupling end of the rabble arm 26 received in the socket 100 of the rabble arm fixing node 28 (see FIG. 3 &5). The plug body 110 is cast solid body with several bores therein, which is advantageously made of refractory steel. The socket 100 has therein two concave conical seat surfaces 112, 114 separated by a concave cylindrical guiding surface 116. The plug body 110 has thereon two convex conical counter-seat surfaces 112', 114' separated by a convex cylindrical guiding surface 116'. All these conical surface 112, 114, 112', 114' are ring surfaces of a single cone, i.e. have the same cone angle. This cone angle should normally be greater than 10° and smaller than 30° and is normally within the range of 18° to 22°. When the plug body 110 is axially inserted into the socket 100, the convex conical counter-seat surface 112' is pressed against the concave conical seat surface 112 and the convex conical counter-seat surfaces 114' is pressed against the concave conical seat surfaces 114.

When securing a new rabble arm 26 to the shaft 20, the plug body 110 of the rabble arm 26 has to be introduced into the socket 100 of the rabble arm fixing nod 110. During this introduction movement, the outer concave conical seat surface 114 first guides the plug body 110 into axial alignment with the cylindrical guiding surface 116. Thereafter both cylindrical guiding surfaces 116 and 116' cooperate with one another for axially guiding the plug body 110 into its final seat position in the socket 100. It will be appreciated that axial guidance provided by the two cylindrical guiding surfaces 116 and 116' considerably reduces the risk of damaging the plug body 110 or the socket 100 during the final coupling operation.

The rabble arm 26 further comprises an arm support tube 120 welded with one end to a shoulder surface 122 on the rear side of the plug body 110. This arm support tube 120 has to withstand the forces and torques acting on the rabble arm. It advantageously consists of a thick walled stainless steel tube extending over the whole length of the rabble arm 26. A gas guiding tube 124 is arranged inside the arm support tube 122 and cooperates with the latter to define between them a small annular cooling gap 126 for channeling the cooling gas to the free end of the rabble arm 26. The interior section of the gas guiding tube 124 forms a central return channel 128 through which the cooling gas flows back from the free end of the rabble arm 26 to the plug body 110.

It will be noted that one end of the gas guiding tube 124 is welded to a cylindrical extension 130 on the rear side of the plug body 110. The diameter of this cylindrical extension is smaller than the internal diameter of the arm support tube 120, so that an annular chamber 131 remains between the cylindrical extension 130 and the arm support tube 120 surrounding the cylindrical extension 130. This annular chamber 131 is in direct communication with the small annular cooling gap 126 between the gas guiding tube 124 and the arm support tube 122.

As already explained above, the plug body 110 is a solid cast body comprising several bores that will now be described. In FIG. 6, reference number 132 identifies an central hole extending axially through the plug body 110, from an end face 134 on the cylindrical extension 130 to a front face 136 on the front end of the plug body 110. The purpose of this central hole 132 will be described later. Reference number 140 in FIG. 6 identifies gas return bores arranged in the plug body 110 around the central hole 132 and having inlet openings 140' in the end face 134 and outlet openings 140" in the front face 136 of the plug body 110 (there are four of such gas return bores 140 arranged around the central hole 132). These gas return bores 140 form communication channels between the return channel 128 in the rabble arm 26 and a gas outlet chamber 142 remaining in the socket 100 between the front face 136 of the plug body 110 and a bottom surface 144 of the socket 100 when the plug body 110 is seated therein. From this gas outlet chamber 142, the cooling gas returning from the rabble arm 26 overflows through the through hole 104 into the central passage 90 of the rabble arm fixing node 28, i.e. into the central exhaust channel 56 of the shaft 20. Reference number 146 in FIG. 5 identifies four gas supply bores arranged in the plug body 110. These gas supply bores 146 have inlet openings 146' in the convex cylindrical guiding surface 116' of the plug body 110 and outlet openings 146" in the cylindrical surface of the cylindrical extension 130. It will be noted that the inlet openings 146' in the convex cylindrical guiding surface 116' are overlapping with the gas outlet openings 102" of the oblique bores 102 in the ring shaped body 70. It is recalled in this context that these oblique bores 102 form the cooling gas supply channels 62 for the rabble arm 26 in the rabble arm fixing node 28. Consequently, when the plug body 110 is seated in its socket 100, the gas supply bores 146 form communication channels in the plug body 110 between the annular chamber 131, which is in direct communication with the small annular cooling gap 126 in the rabble arm 26, and the cooling gas supply for the rabble arm 26 in the rabble arm fixing node 28. It will be appreciated that a positioning pin 148 in the front end of the plug body 110 co-operates with a positioning bore in the bottom surface 144 of the socket 100 to warrant an angular alignment of the inlet openings 146' in the convex cylindrical guiding surface 116' of the plug body 110 with the gas outlet openings 102" in the concave cylindrical guiding surface 116 in the socket 100 when the plug body 110 is inserted into the socket 100. For sealing off the gas passages between the rabble arm fixing node 28 and the plug body 110 in the socket 100, the convex conical counter-seat surfaces 112', 114' of the plug body 110 are advantageously equipped with one or more temperature resistant seal rings (not shown). Furthermore, for improving the sealing function of the convex conical counter-seat surfaces 112', 114' in the socket 100, the latter are advantageously recovered with a temperature resistant sealing paste.

Referring now to FIG. 6, novel preferred securing means for securing the plug body 110 in its socket 100 will be described. This novel securing means comprises a clamping bolt 150. The latter comprises a cylindrical bolt shank 152 loosely fitted in the central hole 132 of the plug body 110. This bolt shank 152 supports on the front side of the plug body 110 a bolt head 154, which advantageously has the form of a hammer head defining a shoulder surface 156', 156" on each side of the shank 152. On the rear side of the plug body 110, the bolt shank 152 has a threaded bolt end 158. The preferred securing means shown in FIG. 6 further comprises a threaded sleeve 160 (or a standard nut) that is screwed onto the threaded bolt end 158 protruding out of the central hole 132 of the plug body 110 on the rear side of the latter.

FIG. 6 shows the axial clamping device in a clamping position in which it firmly presses the plug body 110 into the socket 100. In this clamping position the threaded sleeve 160 bears against an abutment surface on the rear side of the plug body 110. This abutment surface corresponds e.g. to the end surface 134 of the cylindrical extension 130 of the plug body 110. On the other side of the plug body 110, the bolt shank 152 extends through the gas outlet chamber 142 and the through hole 104 in the bottom of the socket 104 into the central passage 90 of the rabble arm fixing node 28. Here, the hammer head 154 of the bolt 150 is in hooking engagement with an abutment surface 162 in the arm fixing node 28, wherein its two shoulder surface 156', 156" bear against the abutment surface 162. It will be appreciated that the clamping bolt 150 is sufficiently preloaded, i.e. the threaded sleeve 160 is tightened with a predetermined torque, to warrant that the plug body 110 is always firmly pressed into the socket 100 during operation of the MHF.

When one of the rabble arms 26 is dismounted, the clamping bolt 150 is extracted with rabble arm 26, i.e. it remains in the plug body 110 of the rabble arm 26. In order to be able to extract the hammer head 154 through the through hole 104 in the bottom of the socket 100, this through hole has the form of a key hole having a form corresponding roughly to the cross-section of the hammer head 154. It follows that by rotating the hammer head 154 by 90° about the central axis of the bolt shank 152, the hammer head 154 can be brought from the "hooked position" shown in FIG. 6", into an "unhooked position", in which it can be axially extracted through the keyhole 104 into the socket 100. Similarly, when a new rabble arm 26 is mounted, the hammer head 154 is first in a position in which it can axially pass through the key hole 104. Once the plug body 110 is seated in its socket 100, the hammer head 154, which is now located on the other side of key hole 104, can be brought into the "hooked position" shown in FIG. 6 by rotating the hammer head 154 by 90° about the central axis of the bolt shank 152. It will further be appreciated that in the "hooked position" of the clamping bolt 150 shown in FIG. 6, the hammer head 154 leaves a quite large outlet opening for the cooling gas flowing through the through hole 104 into the central gas passage 90.

Figure 7:
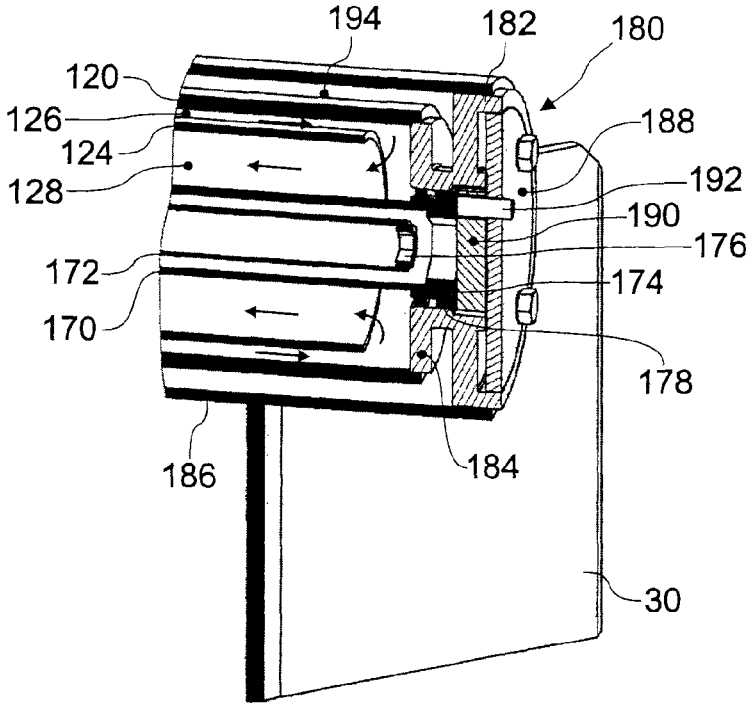
FIG. 7 is a section through a free end of a rabble arm (the section is drawn as a three dimensional view).

The clamping device shown in FIG. 6 also comprises actuation and positioning means for tightening/losing and positioning it from a safe position outside the MHF. This actuation means will now be described with reference to FIG. 6 and FIG. 7. In FIG. 6, reference number 170 identifies an actuation tube that is secured (e.g. welded) with one end to the threaded sleeve 160. Reference number 172 identifies a positioning tube that is secured with one end to the bolt shank 152 (e.g. by means of a bolt 173 welded to the rear end of the positioning tube 172 as shown in FIG. 6). Referring now to FIG. 7, it will be seen that both the actuation tube 170 and the positioning tube 172 axially extend through the intermediate support tube 120 up to the free end of the latter. Here, both the front end of the actuation tube 170 and the front end of the positioning tube 172 include a coupling head 174, 176 for coupling thereto an actuation key (not shown). Both coupling heads 174, 176 may e.g. include a hexagonal socket as shown in FIG. 7. The coupling head 174 of the actuation tube 170 is rotatably supported in a central through-hole 178 of an end-cup 180 and sealed within this through-hole 178. The end-cup 180 comprises on its rear side a first flange 182 closing the front end of the intermediate support tube 120 and on its front side a second flange 184 closing the front end of an outer metallic protecting jacket 186, which will be described later. The positioning tube 172 is rotatably supported with the actuation tube 170. A blind flange 188 is flanged on the front face of the second flange 184 of the end-cup 180, so as to close the central through-hole 178 in the end-cup 180. A thermally insulating plug is inserted between the coupling head 174 and the blind flange 188. Reference number 192 identifies a positioning pin fixed to the blind flange 188. This positioning pin 192 extends through the insulating plug 190 to bear with one end onto the coupling head 174, thereby avoiding a loosening of the threaded sleeve 160.

After removing the blind flange 188 and the thermally insulating plug 190, one has access to the coupling heads 174, 176 of the actuation tube 170 and the positioning tube 172. The actuation tube 170 is used to tighten the threaded sleeve 160. The positioning tube 172 mainly serves as an indicator of the position the hammer head 154 has with regard to the key-hole 104. Its coupling head 176 is therefore provided with an adequate positioning mark. It will be noted that the positioning tube 172 may also be used for fixing the clamping bolt 150 while loosening the threaded sleeve 160 by means of the actuation tube 170. Finally, the coupling head 174 of the actuation tube 170 may also have marks thereon, which in combination with the marks on the coupling head 176 of the positioning tube allow to check whether a sufficient tightening torque has been applied to the clamping device. It remains to be noted that the blind flange 188 may be removed during operation of the cooling system without a substantial gas leakages. Indeed, the threaded sleeve 160 seals the rear end of the actuation tube 170 and the front end of the actuation tube is sealed within the central through-hole 178 in the end-cup 180.

The aforementioned metallic protecting jacket 186, which is seen on FIGS. 4 to 7, recovers a micro porous thermal insulation layer 194 arranged on the intermediate support tube 120. Anti-rotating means, as e.g. identified with reference number 196 in FIG. 6, interconnect the metallic protecting jacket 186 and the intermediate support tube 120 and avoid any rotation of the protecting jacket 186 about the central axis of the rabble arm 26. It will be appreciated that in a preferred embodiment of the rabble arm 26, the protecting jacket 186 is made of stainless steel, wherein the rabble teeth 30, which are also are made of stainless steel, are welded directly onto the protecting jacket 186 (see e.g. FIG. 7, showing one of these rabble teeth 70).

The invention claimed is:

1. A multiple hearth furnace comprising:

a vertical rotary hollow shaft including at least one rabble arm fixing node;

at least one rabble arm including a tubular structure for circulating therethrough a cooling fluid and a coupling end that is received like a plug in a socket arranged in said arm fixing node, said coupling end including cooling fluid supply and return means therein; and securing means for securing said rabble arm with its coupling end in said socket, said securing means including:

a clamping bolt for pressing said coupling end into said socket, said clamping bolt protruding out of the coupling end of said rabble arm where it has a bolt head that can be brought by rotation of said clamping bolt about its central axis into and out of hooking engagement with an abutment surface on said arm fixing node; and a threaded sleeve screwed onto a threaded end of said clamping bolt for exerting a clamping force onto said clamping bolt; wherein:

said coupling end has a through boring in which said clamping bolt is rotatably fitted so that its threaded end sticks out of said through boring; and said threaded sleeve, which is screwed onto said threaded end, bears on an abutment surface of said coupling end for exerting said clamping force onto said clamping bolt;

wherein said coupling end is formed by a solid plug body which has a front end and a rear end;

wherein said tubular structure of said rabble arm comprises an arm support tube, which is connected to the rear end of said plug body, and a gas guiding tube, which is arranged inside said arm support tube and cooperates with the latter to define between them a small annular cooling gap for channeling the cooling gas from the shaft to the free end of the rabble arm, and the interior section of said gas guiding tube forms a return channel for the cooling gas;

wherein said cooling fluid supply and return means include at least one cooling fluid supply channel and at least one cooling fluid return channel arranged in said solid plug body around said through boring, wherein at said rear end of said solid plug body, said at least one cooling fluid supply channel is in communication with said small annular cooling gap and said at least one cooling fluid return channel is in communication with said return channel; and said through boring, in which said clamping bolt is rotatably fitted, axially extends through said solid plug body, and said abutment surface, onto which said threaded sleeve bears, is formed on the rear end of said solid plug body.

2. The furnace as claimed in claim 1 wherein said securing means further comprises:

a positioning tube secured with a first end to said clamping bolt and extending through the entire rabble arm up to the free end of the latter.

3. The furnace as claimed in claim 1 wherein said securing means further comprises:

an actuation tube secured with a first end to said threaded sleeve and extending through the entire rabble arm up to the free end of the latter, where its second end supports a coupling head for coupling thereto an actuation key for transmitting a torque to the threaded sleeve via said actuation tube.

4. The furnace as claimed in claim 3, wherein said securing means further comprises:

a positioning tube secured with a first end to said clamping bolt and extending through the entire rabble arm up to the free end of the latter, wherein said positioning tube is co-axial to and rotatably supported within said actuation tube.

5. The furnace as claimed in claim 3, wherein:

one end of said arm support tube is connected to said plug body and the other end is closed by an end-cup; and said actuation tube axially extends through said gas guiding tube and its free end is rotatably supported in a sealed manner in a through hole of said end-cup.

6. The furnace as claimed in claim 1, wherein:

said solid plug body is a solid cast body; and said through boring, in which the cylindrical shank portion is rotatably fitted, said at least one cooling fluid supply channel and said at least one cooling fluid return channel are provided as bores in said solid cast body.

7. The furnace as claimed in claim 1, wherein:

said socket has therein a first concave conical seat surface located in proximity of its bottom surface and a concave cylindrical guiding surface located closer to the entrance opening of said socket;

said plug body has thereon a first convex conical counter-seat surface and a convex cylindrical guiding surface, cooperating with said first concave conical seat surface, respectively said concave cylindrical guiding surface in said socket.

8. The furnace as claimed in claim 7, wherein:

said socket has therein a second concave conical seat surface, said concave cylindrical guiding surface lying between said first concave conical seat surface and said second concave conical seat surface; and said plug body has thereon a second convex conical counter-seat surface, said convex cylindrical guiding surface lying between said first convex conical counter-seat surface and said second convex conical counter-seat surface.

9. The furnace as claimed in claim 8, wherein:

all said conical surface are ring surfaces of a single cone.

10. The furnace as claimed in claim 9, wherein:

said cone has a cone angle within the range of 10° to 30°, preferably within the range of 18° to 22°.

11. The furnace as claimed in claim 8, wherein:

at least one cooling gas channel is arranged in said rabble arm fixing node that has an opening in said concave cylindrical guiding surface; and at least one cooling gas channel is arranged in said plug body of said rabble arm that has an opening in said convex cylindrical guiding surface, wherein said openings are overlapping when said plug body is seated on its seats in said socket.

12. The furnace as claimed in claim 1 wherein:

said rabble arm fixing node comprises a ring-shaped cast body made of refractory steel, said sockets being radially arranged in said ring-shaped cast body.

13. The furnace as claimed in claim 12, wherein:

said shaft includes a support structure consisting of said rabble arm fixing nodes and of intermediate support tubes that are interposed as structural load carrying members between said rabble arm fixing nodes.

14. The furnace as claimed in claim 13, wherein:

said rabble arm fixing nodes and said intermediate support tubes are assembled by welding.

15. The furnace as claimed in claim 1 wherein at least one section of said shaft extending between two adjacent hearth chambers comprises:

a intermediate support tube fixed between two arm fixing nodes to form an outer shell;

an intermediate gas guiding jacket arranged within said intermediate support tube so as to delimit an annular main cooling gas supply channel between both; and an inner gas guiding jacket arranged within said intermediate support tube so as to delimit annular main cooling gas distribution channel between both, said inner gas guiding jacket further defining the outer wall of a central exhaust channel.

16. The furnace as claimed in claim 15, wherein said arm fixing node comprises a ring-shaped cast body including:

at least one of said sockets for receiving therein said plug body of said rabble arm;

a central passage forming said central exhaust channel for the cooling gas within said arm fixing node;

first secondary passages arranged in a first ring section of said cast body, so as to provide gas passages for cooling gas flowing through said annular main cooling gas distribution channel;

second secondary passages arranged in a second ring section of said cast body, so as to provide gas passages for cooling gas flowing through said annular main cooling gas supply channel;

a first channel means arranged in said cast body, so as to interconnect said annular main cooling gas supply channel with a gas outlet opening within said at least one socket; and a second channel means arranged in said cast body, so as to interconnect a gas inlet opening within said at least one socket with said central passage.

17. The furnace as claimed in claim 16, wherein:

said second channel means comprises a through hole in axial extension of said socket.

18. The furnace as claimed in claim 16, wherein:

said first channel means comprises at least one oblique bore extending through said ring-shaped cast body from said second ring section into a lateral surface delimiting said socket.

19. The furnace as claimed in claim 1 wherein:

said arm support tube is a thick walled stainless steel tube extending over the whole length of the rabble arm and welded with one end to a shoulder surface on the rear side of the plug body.

20. The furnace as claimed in claim 1 wherein said rabble arm further comprises:

a micro porous thermal insulation layer arranged on said arm support tube; and a metallic protecting jacket covering said micro porous thermal insulation layer.

21. The furnace as claimed in claim 20, wherein said rabble arm further comprises:

metallic rabble teeth fixed to said metallic protecting jacket by welding;

and anti-rotation means arranged between said arm support tube and said metallic protecting jacket.

* * * * *